United States Patent [19]

Lynch et al.

[11] Patent Number: 4,633,140

[45] Date of Patent: Dec. 30, 1986

[54] ELECTRODELESS LAMP HAVING STAGGERED TURN-ON OF MICROWAVE SOURCES

[75] Inventors: Donald Lynch, Gaithersburg; Mohammad Kamarehi, Rockville; Michael G. Ury, Bethesda, all of Md.

[73] Assignee: Fusion Systems Corporation, Rockville, Md.

[21] Appl. No.: 686,042

[22] Filed: Dec. 24, 1984

[51] Int. Cl.[4] ..... H05B 41/16; H05B 41/24

[52] U.S. Cl. ..... 315/248; 313/493; 315/39; 315/344

[58] Field of Search ..... 315/248, 176, 156, 151, 315/39, 111.21, 344; 313/493

[56] References Cited

U.S. PATENT DOCUMENTS

| | | | |
|---|---|---|---|
| 3,814,983 | 6/1974 | Weissfloch et al. | 315/39 |
| 3,872,349 | 3/1975 | Spero et al. | 315/39 |
| 4,042,850 | 8/1977 | Ury et al. | 315/39 |
| 4,266,162 | 5/1981 | McNeill et al. | 315/39 |
| 4,359,668 | 11/1982 | Ury | 315/248 X |
| 4,431,947 | 2/1984 | Ferriss et al. | 315/248 X |
| 4,485,332 | 11/1984 | Ury et al. | 315/248 X |
| 4,521,717 | 6/1985 | Kieser | 315/39 |

*Primary Examiner*—Saxfield Chatmon

*Attorney, Agent, or Firm*—Pollock, Vande Sande & Priddy

[57] ABSTRACT

A microwave powered electrodeless light source which is powered by two magnetrons which are excited successively.

7 Claims, 6 Drawing Figures

FIG. 1
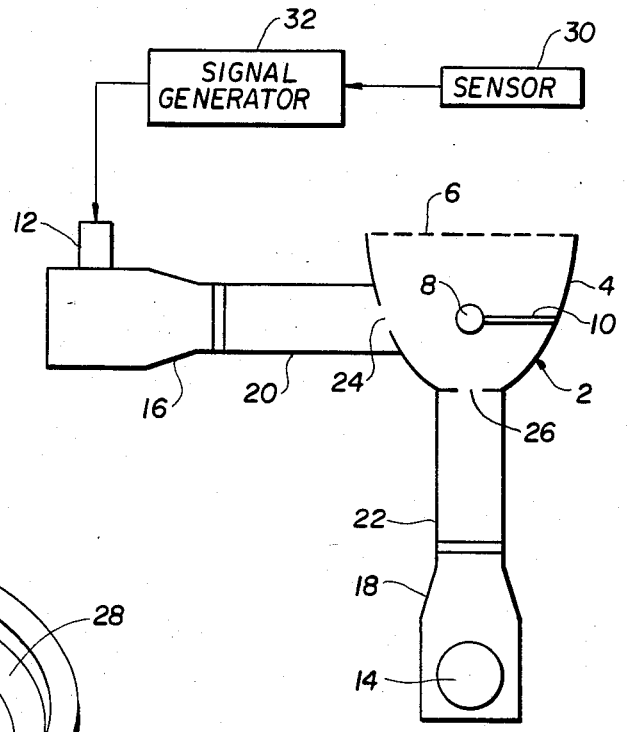
FIG. 2
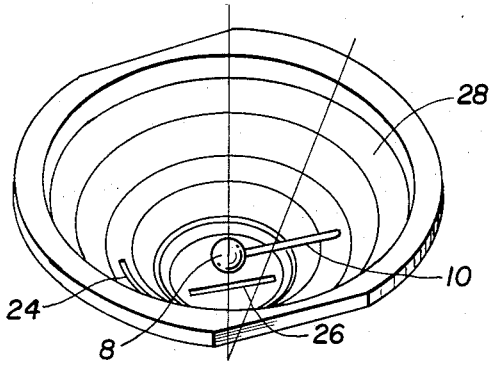
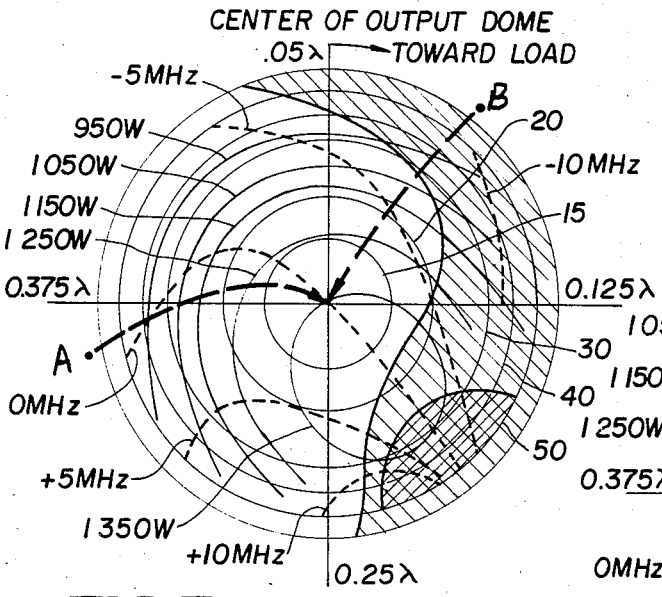
FIG. 3
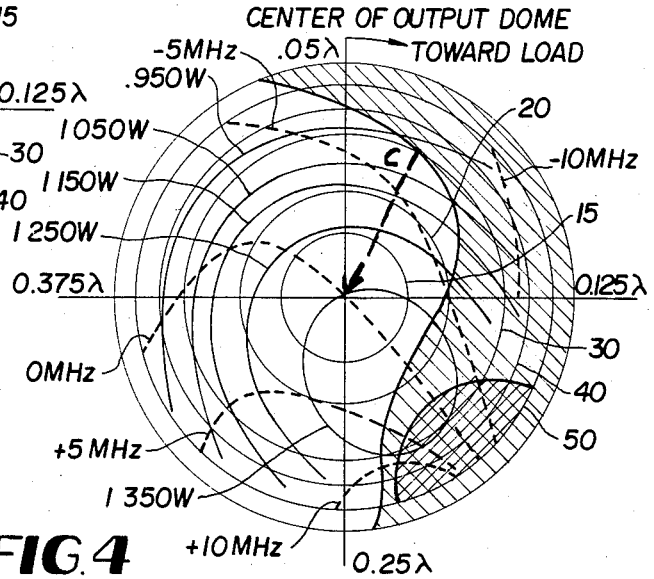
FIG. 4

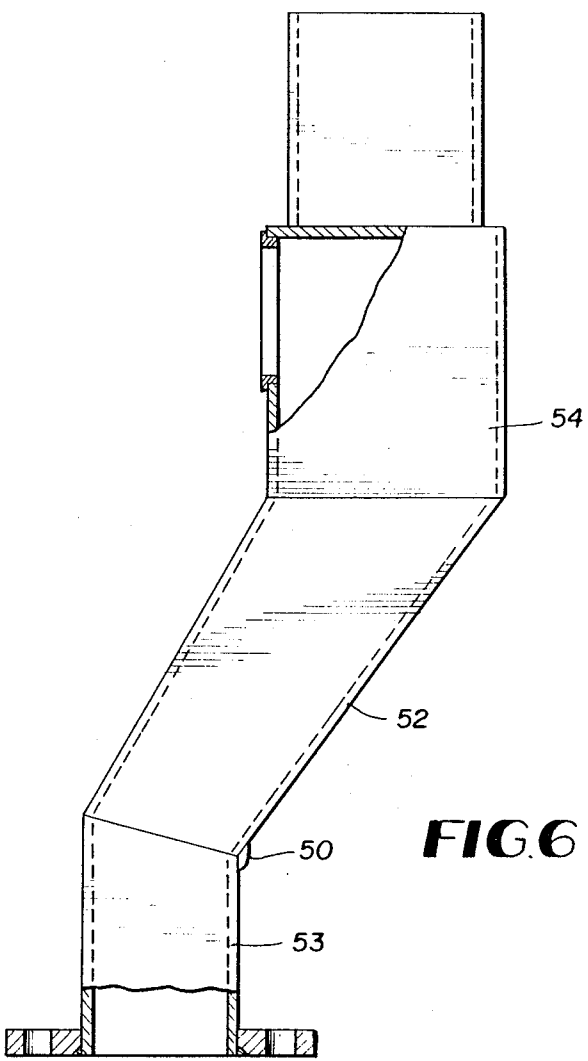
FIG. 6
FIG. 5
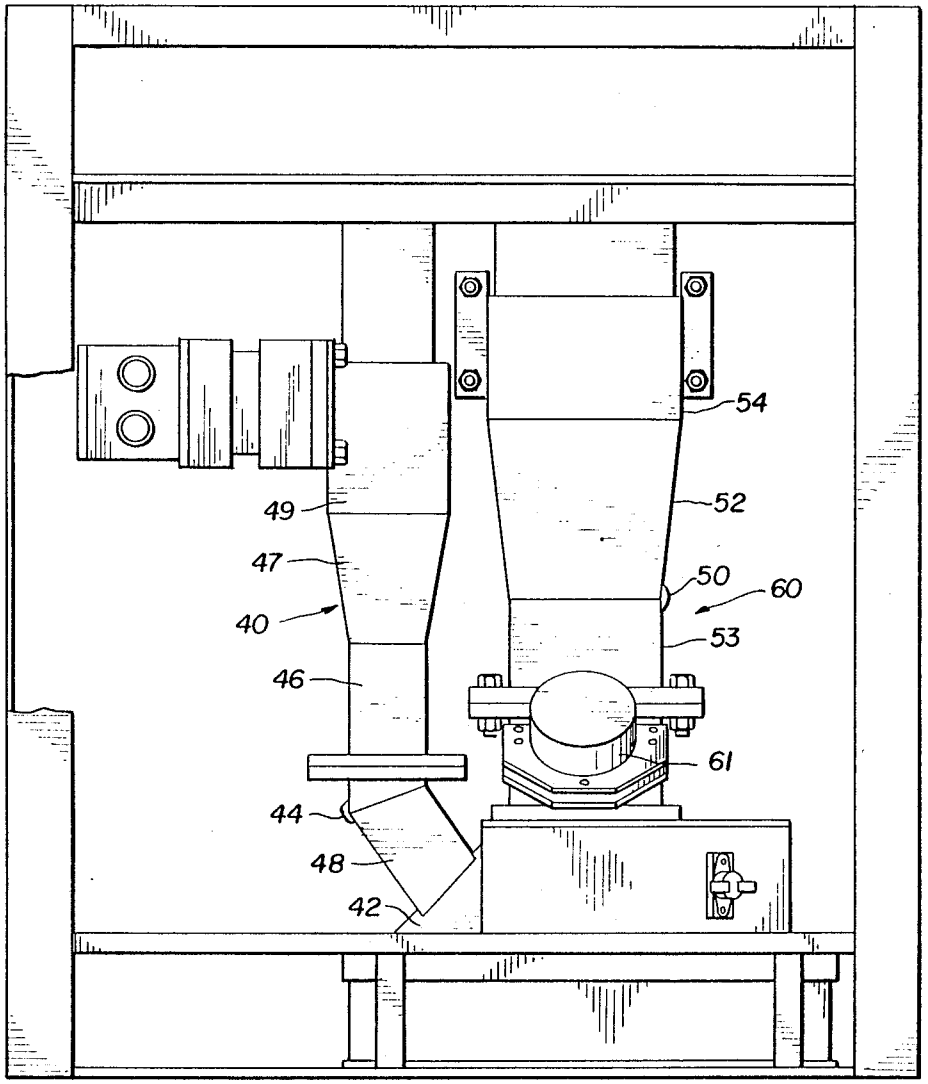

ELECTRODELESS LAMP HAVING STAGGERED TURN-ON OF MICROWAVE SOURCES

The present invention is directed to an improved microwave powered electrodeless light source which utilizes two magnetrons which are excited successively.

Microwave powered electrodeless light sources are known, and generally electrodeless light sources include a microwave chamber in which there is disposed an envelope or bulb containing a plasma-forming medium. A magnetron is provided for generating microwave energy, which is coupled to the chamber through a slot for exciting a plasma in the bulb, which emits radiation upon being excited. This radiation exits from the microwave chamber through a chamber portion which is opaque to microwave energy but transparent to the radiation emitted from the bulb.

Recently, an electrodeless light source which utilizes two magnetrons feeding the microwave chamber has been proposed, and such a source is disclosed in copending U.S. application Ser. No. 677,137.

While the system comprised of waveguide, coupling slot, chamber and bulb, through experimentation, can be tuned for starting and operation conditions when only a single waveguide and slot is used, when two waveguides and slots are present, it may be difficult to tune both coupling systems for starting and operating conditions.

In this regard, it should be understood that the loss of the load, which is the bulb being ignited, changes greatly from the condition when the bulb is off to the condition when it is ignited and is operating in the steady state. Thus, before ignition, the loss is low, and when microwave power is first supplied to the bulb there is substantial reflected power.

Thus, in order to result in stable start up and operation over the range of conditions which is encountered during the start-up and steady state operation, the system comprised of waveguide, coupling slot, chamber and bulb must be finely tuned. To effect such tuning, parameters such as relative bulb-slot position, slot size, chamber shape, etc., are varied until optimum tuning is attained. If such tuning is not achieved, the magnetron may be destroyed or its lifetime reduced.

As mentioned above, in the case where only one magnetron and coupling slot are used, it has been found that it is possible to achieve the required fine tuning. However, when two magnetrons and coupling slots are used, conflicting considerations arise, and it may become extremely difficult to effect tuning of both coupling systems simultaneously.

In accordance with the present invention, a method and apparatus are provided which permits the use of two magnetrons and coupling slots without the above-mentioned problems occurring. In fact, in accordance with the invention, and coupling system can remain relatively untuned for startup conditions, thus allowing considerable flexibility in its design parameters, such as waveguide length and shape.

The solution provided by the present invention is to stagger the turn on of the respective magnetrons. Thus, the first magnetron on starts the lamp, and accordingly its coupling system is fine tuned as discussed above to result in stable ignition and operating conditions. However, the second magnetron is not excited until after the bulb is ignited, so that it is feeding into a relatively lossy load. Accordingly, the coupling system associated with the second magnetron can be much more broadly tuned resulting in greater design flexibility. Additionally, the second magnetron will have a longer lifetime than the first, since it is not experiencing the relative mismatch which is encountered in bulb starting.

It is therefore an object of the invention to provide a method and apparatus for effectively and efficiently starting and operating a microwave powered electrodeless light source with two or more magnetrons.

It is a further object to provide such a method and apparatus which permits greater design flexibility.

It is still a further object of the invention to provide such a method and apparatus which results in longer magnetron life.

The invention will be better understood by referring to the accompanying drawings in which:

FIG. 1 is a diagrammatic illustration showing a lamp which incorporates the invention.

FIG. 2 illustrates the respective coupling slot orientations of the lamp of FIG. 1.

FIGS. 3 and 4 are Rieke diagrams which illustrate the principle of the invention.

FIGS. 5 and 6 illustrate a preferred waveguide configuration.

Referring to FIG. 1, an approximate cross-section of microwave powered electrodeless light source 2 is shown, which includes a microwave chamber, comprised of reflector 4 and mesh 6.

Bulb 8 is disposed in the chamber, and mesh 6 is effective to allow the ultraviolet or visible radiation which is emitted by bulb 8 to exit while retaining the microwave energy in the chamber. Bulb 8 is mounted by stem 10, which is rotated while cooling fluid streams are directed at the bulb to result in effective cooling as disclosed in U.S. Pat. No. 4,485,332.

Microwave energy generated by magnetrons 12 and 14, is coupled to the microwave chamber through launchers 16 and 18 and waveguides 20 and 22 respectively. Referring to FIG. 2, waveguide 20 feeds coupling slot 24 in the chamber, while waveguide 22 feeds coupling slot 26. FIG. 2 more clearly shows that the chamber 4 in certain embodiments may be comprised of a plurality of segments 28, each of which is relatively flattened as described in greater detail in U.S. application Ser. No. 707,159, while in other embodiments may be of varying geometric shapes, depending on the optical result required.

As discussed above, in order to provide for effective startup of the bulb and for stable operation over the range of conditions encountered during startup and steady state operation, the system comprised of waveguide, coupling slot, chamber and bulb must be finely tuned. In lamps using a single waveguide and coupling slot, such tuning is effected by experimentally varying the controlling parameters including relative bulb-slot position, slot size, and chamber shape until optimum tuning is achieved. If fine tuning is not achieved then the magnetron may be destroyed or its lifetime reduced.

However, it was found that when two or more magnetrons and waveguides are used, it may be extremely difficult or not possible to fine tune such multiple systems simultaneously. For example, a bulb position which might be ideal for one slot position might not result in the required match for the other slot over the range of conditions experienced in starting and operating the bulb.

In accordance with the method and apparatus of the present invention, the magnetrons are turned on successively. According to such method, the second magnetron is not excited until after the lamp bulb has ignited. Thus, problems with mismatch are avoided and the coupling system associated with the second magnetron can be tuned more broadly, thus resulting in greater design flexibility.

Referring to FIG. 1, magnetron 14 is first excited by supplying electrical power to it. After bulb 8 is ignited, magnetron 12 is excited. In the preferred embodiment, this is accomplished automatically, for example, as shown in FIG. 1, photosensor 30 is provided which feeds signal generating means 32. Signal generating means 32 is arranged to generate a signal which results in electrical power being provided to magnetron 12 when the light output of bulb 8 reaches a certain level as detected by sensor 30.

By utilizing the present invention, magnetron 12, the second magnetron on, lasts longer than it would if used for starting the lamp. Additionally, the system comprised of magnetron 12, waveguide 20 and slot 24 can be more broadly tuned than if used for starting, which allows greater flexibility in the length and shape of waveguide 20. This allows the overall lamp system to be more easily accommodated in available mechanical space.

The advantages of the invention may be better understood by referring to the Rieke diagrams depicted in FIGS. 3 and 4. Thus, the lifetime of a magnetron is maximized if it is operated within certain constraints shown in the Rieke diagram. The shaded region represents operating conditions that reduce the lifetime of the magnetron due to backheating, electron bombardment or moding (the generation of higher order frequencies).

FIG. 3 gives two possible start up paths for the magnetron when operating the electrodeless lamp. The cavity is initially low loss and therefore a high standing wave ratio (SWR) exists. As the bulb ignites, the SWR decreases as the load becomes more lossy.

The path the magnetron takes depends on chamber shape, slot size and orientation, bulb position and waveguide length. Path B is not desirable since it passes through the shaded region. Path A does not pass through the shaded area and is the preferred path.

Path A is obtained by carefully adjusting the design parameters mentioned above.

Once the bulb has reached its steady state condition the SWR is very low since the load is now very lossy. If a second magnetron is turned on at this point the magnetron is initially coupling to a lossy load and hence the SWR for that magnetron-waveguide-cavity is initially low.

A low SWR allows the magnetron to start up at path C shown in FIG. 4. Path C avoids the shaded region due to the low SWR. Thus the design parameters mentioned above have more flexibility. For instance the parameters which produced path B could product path C if used in connection with the second magnetron.

Referring again to FIGS. 1 and 2, it is noted that coupling slots 24 and 26 are oriented so that they are substantially orthogonal to each other. As discussed in co-pending U.S. application Ser. No. 677,137, this results in the energy modes which are coupled to the chamber from the respective waveguides being substantially de-coupled from each other, as the respective energy waves are cross-polarized.

Further, in order to provide a uniform radiation output from the bulb, it is arranged to have a maximum dimension which is substantially smaller than a wavelength of the microwave energy utilized. The use of two or more de-coupled microwave energy modes, as depicted in the embodiments of FIGS. 1 and 2 further increases the uniformity of the radiation which is emitted by the bulb.

A working embodiment in accordance with FIGS. 1 and 2 has been utilized as the ultraviolet source in a photostabilization apparatus. The waveguide configuration utilized in this embodiment is depicted in FIGS. 5 and 6. As shown in FIG. 5, waveguide means 40 which feeds chamber 42 is incident to the chamber at an angle as illustrated and is then bent at portion 44, while the top part of the waveguide means beginning with portion 46 is vertical. Waveguide means 60 feeds the chamber from a vertical orientation and is bent at portion 50 so that portion 52 is angled so as to extend out of the plane of the paper in FIG. 5, while top portion 54 is vertical. The structural configuration of waveguide means 60 is shown in greater detail in FIG. 6. Motor 61 rotates the bulb stem and bulb to effect cooling as discussed above. The magnetron associated with waveguide 40 is the first magnetron on in the working embodiment.

In the preferred embodiment, the approximate lengths of the waveguide sections are as follows:

| Section | Length |
|---|---|
| 48 | 1.5" |
| 52 | 2.0" |
| 54 | 4.0" |
| 41 | 2.5" |
| 46 | 2.5" |
| 47 | 2.5" |
| 49 | 3.0" |

Additionally, a segmented reflector as shown in FIG. 2 is utilized and the magnetrons are the Hitachi 2M131 each of which generates microwave energy at 2450 Mhz at approximately 1.5 kw. It is noted that the specific Rieke diagram shown in FIGS. 3 and 4 corresponds to this magnetron. The chamber has a maximum vertical dimension in the figure of approximately 4 inches and a maximum horizontal dimension of approximately 8 inches. Additionally, the coupling slot dimensions are 2.5 inches by 0.3 inches and the position of the bulb is 2.0 inches from mouth of the cavity along the central axis.

While the illustrative embodiment utilizes two magnetrons and waveguides, it is to be understood that more than two may be utilized so long as only one magnetron is used to start the lamp. Further, it is to be understood that while an illustrative embodiment of the invention has been disclosed above, variations will occur to those skilled in the art, and the scope of the invention is to be limited only by the claims appended hereto and equivalents.

We claim:

1. A method of operating a microwave powered electrodeless light source comprised of a bulb containing an ionizable medium which is disposed in a microwave chamber which is fed by two microwave sources, comprising the steps of, exciting one of said microwave sources by supplying electrical power to it, and after said bulb is ignited, exciting the other of said microwave sources by supplying electrical power to it.

2. A microwave powered electrodeless light source comprising, a microwave chamber, a bulb containing an ionizable medium disposed in said chamber, first and second microwave energy generating means, means for coupling the microwave energy generated by said microwave energy generating means to said chamber, means for exciting said first microwave energy generating means to provide microwave energy to said bulb for igniting said bulb, and means for exciting said second microwave energy generating means after said bulb has been ignited to provide microwave energy to said bulb during the operation thereof in addition to the energy provided by said first microwave energy generating means.

3. The electrodeless light source of claim 2 wherein the system comprised of said microwave chamber, bulb and coupling means are finely tuned for the microwave energy supplied by said first microwave energy generating means but not for the energy supplied by said second microwave energy generating means.

4. The electrodeless light source of claims 2 or 3 wherein said bulb to which the microwave energy from said first and second microwave energy generating means is coupled to has a maximum dimension which is smaller than a wavelength of said microwave energy.

5. The electrodeless light source of claims 2 or 3 wherein said coupling means comprises first and second waveguide means and first and second slots in said chamber, which are coupled respectively to said first and second microwave energy generating means.

6. The electrodeless light source of claims 2 or 3 further including means for determining when said bulb has ignited and for generating a signal indicative thereof, and wherein said means for exciting said second microwave energy generating means is responsive to said signal for exciting said second microwave energy generating means after said bulb is ignited.

7. The electrodeless light source of claim 2 or 3 wherein said bulb has a maximum dimension which is smaller than a wavelength of said microwave energy, and further including means for determining when said bulb has ignited and for generating a signal indicative thereof, said means for exciting said second microwave energy generating means being responsive to said signal for exciting said second microwave energy generating means after said bulb is ignited.

* * * * *